US010221642B2

(12) United States Patent
Zhang et al.

(10) Patent No.: US 10,221,642 B2
(45) Date of Patent: Mar. 5, 2019

(54) DOWNHOLE TOOLS HAVING CONTROLLED DEGRADATION AND METHOD

(71) Applicants: Zhihui Zhang, Katy, TX (US); Zhiyue Xu, Cypress, TX (US); Goang-Ding Shyu, Houston, TX (US); Juan Carlos Flores Perez, The Woodlands, TX (US); James Doane, Friendswood, TX (US); Yingqing Xu, Tomball, TX (US)

(72) Inventors: Zhihui Zhang, Katy, TX (US); Zhiyue Xu, Cypress, TX (US); Goang-Ding Shyu, Houston, TX (US); Juan Carlos Flores Perez, The Woodlands, TX (US); James Doane, Friendswood, TX (US); Yingqing Xu, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/599,128

(22) Filed: May 18, 2017

(65) Prior Publication Data

US 2018/0283142 A1 Oct. 4, 2018

Related U.S. Application Data

(63) Continuation-in-part of application No. 15/472,382, filed on Mar. 29, 2017.

(51) Int. Cl.
*E21B 29/02* (2006.01)
*E21B 41/00* (2006.01)
(Continued)

(52) U.S. Cl.
CPC ..... *E21B 29/02* (2013.01); *E21B 23/04* (2013.01); *E21B 29/00* (2013.01); *E21B 31/002* (2013.01);
(Continued)

(58) Field of Classification Search
CPC ..... E21B 29/00; E21B 29/02; E21B 34/16
See application file for complete search history.

(56) References Cited

U.S. PATENT DOCUMENTS 6,253,843 B1 7/2001 Rawson et al.
7,270,191 B2 9/2007 Drummond et al.
(Continued)

FOREIGN PATENT DOCUMENTS

WO 2013022635 A2 2/2013

OTHER PUBLICATIONS

"Spectre Disintegrating Frac Plug", Baker Hughes, 2015, 8 Pages.
(Continued)

*Primary Examiner* — Giovanna C. Wright
*Assistant Examiner* — Tara E Schimpf
(74) *Attorney, Agent, or Firm* — Cantor Colburn LLP

(57) ABSTRACT

A downhole assembly includes a downhole tool including a degradable-on-demand material including: a matrix material; and, a unit in contact with the matrix material. The unit includes a core including an energetic material configured to generate energy upon activation to facilitate degradation of the downhole tool; and, an activator disposed in contact with the core, the activator including a triggering system having an electrical circuit and an igniter within the electrical circuit, the electrical circuit having an open condition and a closed condition, the electrical circuit configured to be in the closed condition after movement of an object downhole that engages directly or indirectly with the triggering system, and the igniter arranged to ignite the energetic material in the closed condition of the electrical circuit. In the open condition of the electrical circuit the igniter is inactive, and in the closed condition of the electrical circuit the igniter is activated.

24 Claims, 10 Drawing Sheets

(51) Int. Cl.

| | |
|---|---|
| ***E21B 23/04*** | (2006.01) |
| ***E21B 31/00*** | (2006.01) |
| ***E21B 31/107*** | (2006.01) |
| ***E21B 41/02*** | (2006.01) |
| ***E21B 29/00*** | (2006.01) |
| *E21B 23/03* | (2006.01) |
| *E21B 33/037* | (2006.01) |
| *C22C 18/00* | (2006.01) |
| *C22C 19/00* | (2006.01) |
| *E21B 34/06* | (2006.01) |

(52) U.S. Cl.

CPC ..... *E21B 31/1075* (2013.01); *E21B 41/0085* (2013.01); *E21B 41/02* (2013.01); *C22C 18/00* (2013.01); *C22C 19/00* (2013.01); *E21B 23/03* (2013.01); *E21B 31/107* (2013.01); *E21B 33/0375* (2013.01); *E21B 34/066* (2013.01)

(56) References Cited

U.S. PATENT DOCUMENTS

| | | | | |
|---|---|---|---|---|
| 8,056,638 | B2 | 11/2011 | Clayton et al. | |
| 8,235,102 | B1 | 8/2012 | Robertson | |
| 8,256,521 | B2 | 9/2012 | Swor et al. | |
| 8,272,446 | B2 | 9/2012 | Swor et al. | |
| 8,291,969 | B2 | 10/2012 | Swor et al. | |
| 8,291,970 | B2 | 10/2012 | Swor et al. | |
| 8,322,449 | B2 | 12/2012 | Clayton et al. | |
| 8,327,926 | B2 | 12/2012 | Robertson | |
| 8,403,037 | B2 | 3/2013 | Agrawal et al. | |
| 8,528,633 | B2 | 9/2013 | Agrawal et al. | |
| 9,022,107 | B2 | 5/2015 | Agrawal et al. | |
| 9,101,978 | B2 | 8/2015 | Xu et al. | |
| 9,267,347 | B2 | 2/2016 | Agrawal et al. | |
| 2007/0209802 | A1 | 9/2007 | Xu et al. | |
| 2013/0160992 | A1 | 6/2013 | Agrawal et al. | |
| 2014/0014339 | A1* | 1/2014 | O'Malley | E21B 43/261 166/281 |
| 2014/0190685 | A1* | 7/2014 | Frazier | E21B 33/208 166/250.01 |
| 2014/0202712 | A1 | 7/2014 | Fripp et al. | |
| 2014/0251612 | A1 | 9/2014 | Powers | |
| 2014/0262327 | A1 | 9/2014 | Xu et al. | |
| 2014/0363692 | A1 | 12/2014 | Marya et al. | |
| 2015/0027723 | A1* | 1/2015 | Fripp | E21B 34/063 166/373 |
| 2015/0190984 | A1 | 7/2015 | Zhang et al. | |
| 2015/0239795 | A1* | 8/2015 | Doud | C06B 45/32 428/649 |
| 2015/0259263 | A1 | 9/2015 | Shrerman et al. | |
| 2015/0292288 | A1* | 10/2015 | Kasperski | E21B 27/02 166/285 |
| 2016/0130906 | A1 | 5/2016 | Garvey et al. | |
| 2016/0209391 | A1 | 7/2016 | Zhang et al. | |
| 2016/0333668 | A1 | 11/2016 | Xu et al. | |
| 2017/0009563 | A1* | 1/2017 | Holder | E21B 43/263 |
| 2018/0171736 | A1 | 6/2018 | Xu et al. | |
| 2018/0171737 | A1 | 6/2018 | Xu et al. | |
| 2018/0171738 | A1 | 6/2018 | Xu et al. | |
| 2018/0171757 | A1 | 6/2018 | Xu | |

OTHER PUBLICATIONS

Huang et al. "Construction and Properties of Structure- and Size-controlled Micro/nano-Energetic Materials", Defence Technology 9 (2013) 59-79.

International Search Report for International Application No. PCT/US2017/062292, dated Mar. 16, 2018, 4 pages.

Written Opinion of the International Search Report for International Application No. PCT/US2017/062292, dated Mar. 16, 2018, 12 pages.

* cited by examiner

DOWNHOLE TOOLS HAVING CONTROLLED DEGRADATION AND METHOD

CROSS REFERENCE TO RELATED APPLICATIONS

The present application is a continuation-in-part of U.S. patent application Ser. No. 15/472,382, filed Mar. 29, 2017, which is hereby incorporated by reference in its entirety.

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating downhole tools have been developed. Instead of milling or drilling operations, these tools can be removed by dissolution of engineering materials using various wellbore fluids. One challenge for the self-disintegrating downhole tools is that the disintegration process can start as soon as the conditions in the well allow the corrosion reaction of the engineering material to start. Thus the disintegration period is not controllable as it is desired by the users but rather ruled by the well conditions and product properties. For certain applications, the uncertainty associated with the disintegration period can cause difficulties in well operations and planning. An uncontrolled disintegration can also delay well productions. Therefore, the development of downhole tools that can be disintegrated on-demand is very desirable.

BRIEF DESCRIPTION

A downhole assembly includes a downhole tool including a degradable-on-demand material including: a matrix material; and, a unit in contact with the matrix material. The unit includes a core including an energetic material configured to generate energy upon activation to facilitate degradation of the downhole tool; and, an activator disposed in contact with the core, the activator including a triggering system having an electrical circuit and an igniter within the electrical circuit, the electrical circuit having an open condition and a closed condition, the electrical circuit configured to be in the closed condition after movement of an object downhole that engages directly or indirectly with the triggering system, and the igniter arranged to ignite the energetic material in the closed condition of the electrical circuit. In the open condition of the electrical circuit the igniter is inactive, and in the closed condition of the electrical circuit the igniter is activated.

A method of controllably removing a downhole tool of a downhole assembly, the method including: starting a timer in a triggering system of the downhole assembly for a pre-selected time period, the downhole tool including degradable-on-demand material having a matrix material and an energetic material configured to generate energy upon activation to facilitate degradation of the downhole tool; disposing the downhole assembly in a downhole environment; determining if a downhole operation can be completed within the pre-selected time period, and extending the pre-selected time period to an extended time period if the downhole operation cannot be completed within the pre-selected time period; performing the downhole operation using the downhole assembly; activating the energetic material at an end of the pre-selected time period or at an end of the extended time period using the igniter; and degrading the downhole tool.

A frac plug including a body formed of a degradable-on-demand material, the degradable-on-demand material including: a matrix material; and, a unit in contact with the matrix material, the unit including: a core comprising an energetic material configured to generate energy upon activation to facilitate the degradation of the downhole tool; and, at least one layer disposed on the core; a time delay fuse in contact with an uphole end of the body and in contact with the energetic material; and, a ball seat including a piezoelectric material at an uphole end of the time delay fuse; wherein the piezoelectric material is configured to create a spark and ignite the time delay fuse after a ball is seated on the ball seat and pressure is increased on the ball in a downhole direction.

BRIEF DESCRIPTION OF THE DRAWINGS

The following descriptions should not be considered limiting in any way. With reference to the accompanying drawings, like elements are numbered alike:

FIG. 8A illustrates the triggering system in an inactive state and FIG. 8B illustrates the triggering system in an active state;

DETAILED DESCRIPTION

Figure 1:
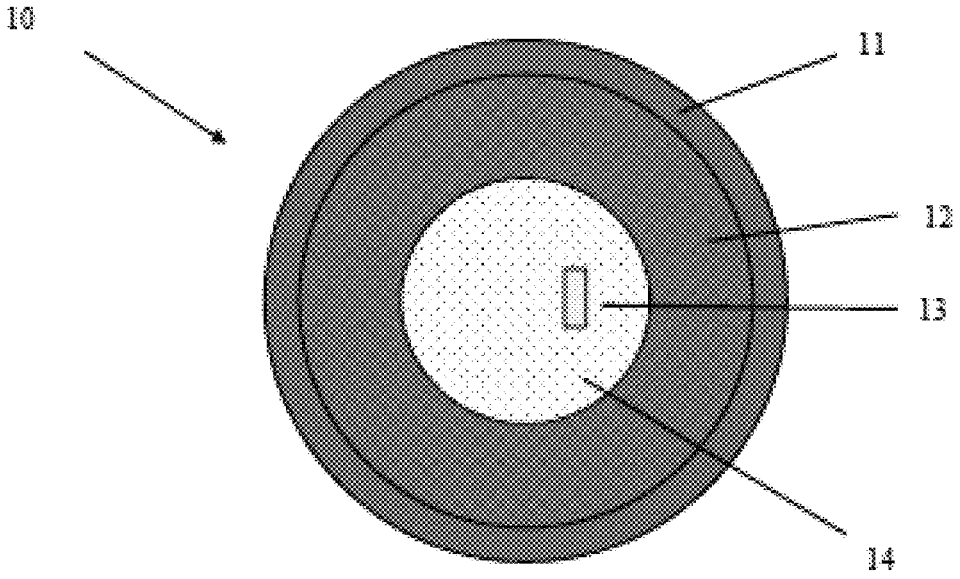
FIG. 1 is a cross-sectional view of an exemplary multilayered unit according to an embodiment of the disclosure.

The disclosure provides a multilayered unit that can be embedded in a downhole article, attached to a downhole article, or disposed between two adjacent components of a downhole assembly. The downhole article or downhole assembly containing the multilayered unit has controlled degradation, including partial or full disintegration, in a downhole environment. The controlled degradation, and more particularly the controlled disintegration, is implemented through integrating a high-strength matrix material with energetic material that can be triggered on demand for rapid tool disintegration.

The multilayered unit includes a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer.

The multilayered unit can have various shapes and dimensions. In an embodiment, the multilayered unit has at least one stress concentration location to promote disintegration. As used herein, a stress concentration location refers to a location in an object where stress is concentrated. Examples of stress concentration locations include but are not limited to sharp corners, notches, or grooves. The multilayered unit can have a spherical shape or an angular shape such as a triangle, rhombus, pentagon, hexagon, or the like. The multilayered unit can also be a rod or sheet. The matrix around the multilayered unit can also have stress concentration locations.

The energetic material comprises a thermite, a thermate, a solid propellant fuel, or a combination comprising at least one of the foregoing. The thermite materials include a metal powder (a reducing agent) and a metal oxide (an oxidizing agent), where choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide and combinations including at least one of the foregoing, for example.

Thermate materials comprise a metal powder and a salt oxidizer including nitrate, chromate and perchlorate. For example thermite materials include a combination of barium chromate and zirconium powder; a combination of potassium perchlorate and metal iron powder; a combination of titanium hydride and potassium perchlorate, a combination of zirconium hydride and potassium perchlorate, a combination of boron, titanium powder, and barium chromate, or a combination of barium chromate, potassium perchlorate, and tungsten powder.

Solid propellant fuels may be generated from the thermate compositions by adding a binder that meanwhile serves as a secondary fuel. The thermate compositions for solid propellants include, but not limited to, perchlorate and nitrate, such as ammonium perchlorate, ammonium nitrate, and potassium nitrate. The binder material is added to form a thickened liquid and then cast into various shapes. The binder materials include polybutadiene acrylonitrile (PBAN), hydroxyl-terminated polybutadiene (HTPB), or polyurethane. An exemplary solid propellant fuel includes ammonium perchlorate ($NH_4ClO_4$) grains (20 to 200 μm) embedded in a rubber matrix that contains 69-70% finely ground ammonium perchlorate (an oxidizer), combined with 16-20% fine aluminum powder (a fuel), held together in a base of 11-14% polybutadiene acrylonitrile or hydroxyl-terminated polybutadiene (polybutadiene rubber matrix). Another example of the solid propellant fuels includes zinc metal and sulfur powder.

As used herein, the activator is a device that is effective to generate spark, electrical current, or a combination thereof to active the energetic material. The activator can be triggered by a preset timer, characteristic acoustic waves generated by perforations from following stages, a pressure signal from fracking fluid, or an electrochemical signal interacting with the wellbore fluid. Other known methods to activating an energetic material can also be used.

The multilayered unit has a support layer to hold the energetic materials together. The support layer can also provide structural integrity to the multilayered unit.

The multilayered unit has a protective layer so that the multilayered unit does not disintegrate prematurely during the material fabrication process. In an embodiment, the protective layer has a lower corrosion rate than the support layer when tested under the same testing conditions. The support layer and the protective layer each independently include a polymeric material, a metallic material, or a combination comprising at least one of the foregoing. The polymeric material and the metallic material can corrode once exposed to a downhole fluid, which can be water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

In an embodiment, the support layer comprises the metallic material, and the protective layer comprises the polymeric material. In another embodiment, the support layer comprises the polymeric material, and the protective layer comprises the metallic material. In yet another embodiment, both the support layer and the protective layer comprise a polymeric material. In still another embodiment, both the support layer and the protective layer comprise a metallic material.

Exemplary polymeric materials include a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

The metallic material can be a corrodible metallic material, which includes a metal, a metal composite, or a combination comprising at least one of the foregoing. As used herein, a metal includes metal alloys.

Exemplary corrodible metallic materials include zinc metal, magnesium metal, aluminum metal, manganese metal, an alloy thereof, or a combination comprising at least one of the foregoing. In addition to zinc, magnesium, aluminum, manganese, or alloys thereof, the corrodible material can further comprise a cathodic agent such as Ni, W, Mo, Cu, Fe, Cr, Co, an alloy thereof, or a combination comprising at least one of the foregoing to adjust the corrosion rate of the corrodible material. The corrodible material (anode) and the cathodic agent are constructed on the microstructural level to form μm-scale galvanic cells (micro-galvanic cells) when the material are exposed to an electrolytic fluid such as downhole brines. The cathodic agent has a standard reduction potential higher than −0.6 V. The net cell potential between the corrodible material and cathodic agent is above 0.5 V, specifically above 1.0 V.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

As used herein, a metal composite refers to a composite having a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the particle core material.

The corrodible metallic material can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W, Cu, Fe, Si, Ca, Co, Ta, or Re. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

In an embodiment, the metallic material comprises Al, Mg, Zn. Mn, Fe, an alloy thereof, or a combination comprising at least one of the foregoing. In specific embodiments, the metallic material comprises aluminum alloy, magnesium alloy, zinc alloy, iron alloy, or a combination comprising at least one of the foregoing. In the instance wherein both the support layer and the protective layer comprise a metallic material, the metallic materials in the support layer and the protective layer are selected such that the support layer and the protective layer are easier to disintegrate when the energetic material is activated as compared to an otherwise identical unit except for containing only one metallic layer.

The core is present in an amount of about 5 to about 80 vol %, specifically about 15 to about 70 vol %; the support layer is present in an amount of about 20 to about 95 vol %, specifically about 30 to about 85; and the protective layer is present in an amount of about 0.1 to about 20 vol %, specifically about 1 to about 10 vol %, each based on the total volume of the multilayered unit.

FIG. 1 is a cross-sectional view of an exemplary multilayered unit according to an embodiment of the disclosure. As shown in FIG. 1, unit 10 has a core 14, an activator 13 disposed in the core, a support layer 12 disposed on the core, and a protective layer 11 disposed on the support layer. Thus, in this embodiment, the unit 10 is a multi-layered unit.

The multilayered units can be embedded into different tools. The location and number of MLM units are selected to ensure that the whole tool can disintegrate into multiple pieces when the energetic material is activated. Thus in an embodiment, the disclosure provides a degradable article, and in particular a disintegrable article, comprising a matrix and a multilayered unit embedded therein. The matrix of the article can be formed from a corrodible metallic material as described herein. The matrix can further comprise additives such as carbides, nitrides, oxides, precipitates, dispersoids, glasses, carbons, or the like in order to control the mechanical strength and density of the articles if needed. In an embodiment, the matrix has pre-cracks including but not limited to pre-crack notches or pre-crack grooves around the multilayered unit to facilitate the quick degradation, and in particular the quick disintegration, of the article once the energetic material is activated.

Figure 2:
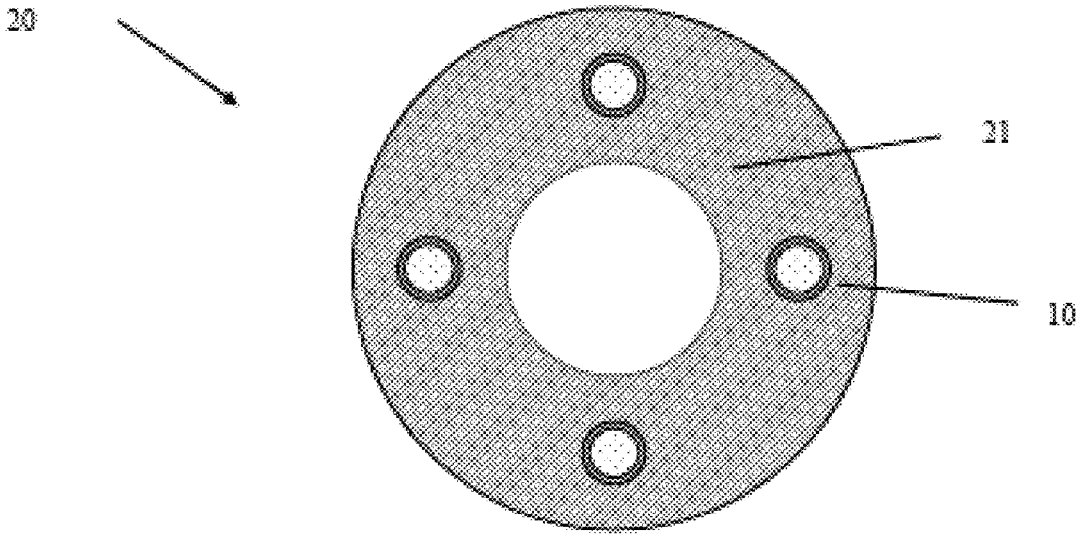
FIG. 2 is a cross-sectional view of an exemplary downhole article embedded with multilayered units.
Figure 3:
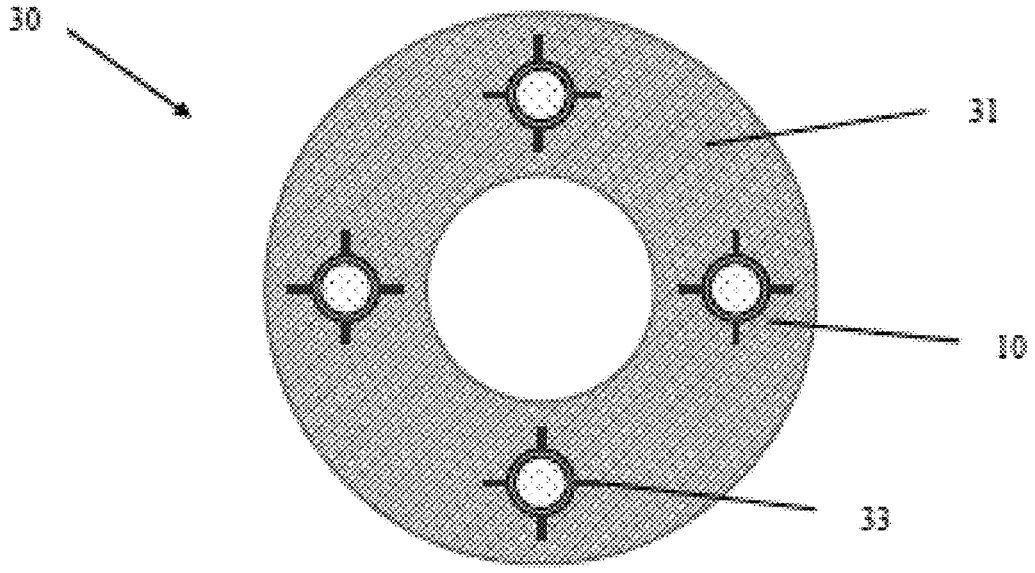
FIG. 3 is a cross-sectional view of another exemplary downhole article embedded with multilayered units, wherein the downhole article has pre-cracks around the multilayered units.
Figure 4:
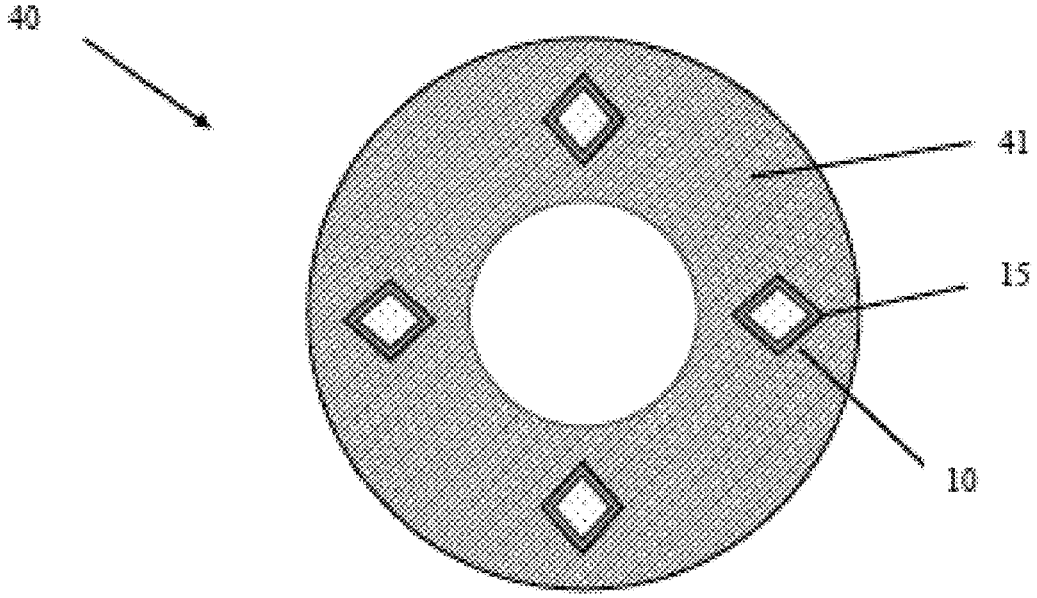
FIG. 4 is a cross-sectional view of yet another exemplary downhole article embedded with multilayered units, wherein the multilayered units and the matrix of the downhole article surrounding the multilayered units have stress concentration locations.
Figure 5:
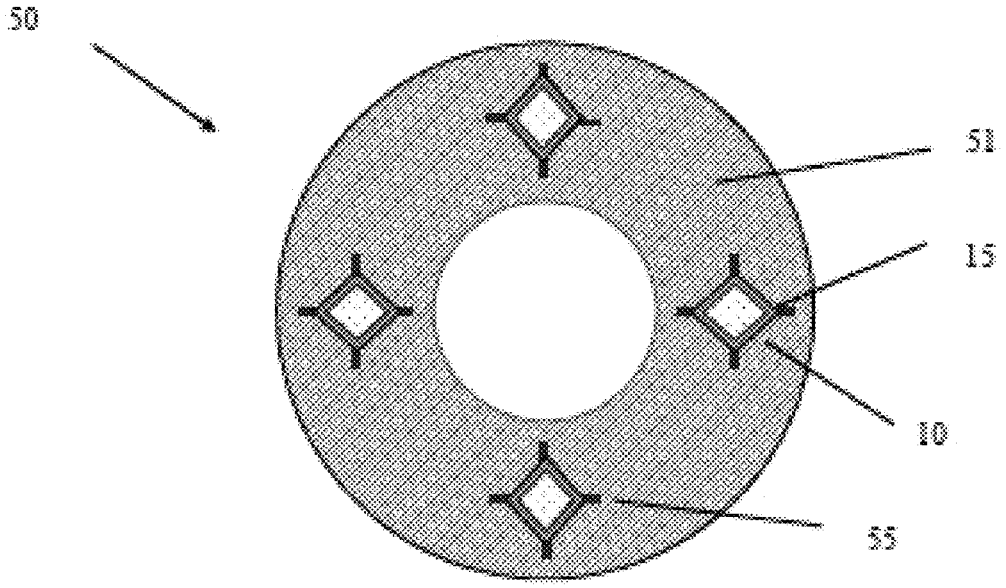
FIG. 5 is a cross-sectional view of still another exemplary downhole article embedded with multilayered units, wherein the multilayered units have stress concentration locations; and the downhole article matrix surrounding the multilayered unit has stress concentration locations as well as pre-cracks.

FIGS. 2-4 are cross-sectional views of various exemplary downhole articles embedded with multilayered units. In downhole article 20, multiple multilayered units 10 as described herein are embedded in matrix 21. In downhole article 30, multilayered units 10 are disposed in matrix 31, wherein matrix 31 has pre-cracks 33. In downhole article 40, multilayered units 10 are embedded in matrix 41, where the multilayered units have stress concentration locations 15. In downhole article 50, the multilayered units have stress concentration locations 15 and the matrix 51 has pre-cracks 55. In any of the above embodiments or combination of embodiments, the degradable-on-demand material includes the multi-layered units and the matrix to which the multi-layered units are in contact.

Degradable articles, and in particular disintegrable articles, are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug. In specific embodiments, the disintegrable article is a ball, a fracture plug, or a bridge plug.

A downhole assembly comprising a downhole article having a multilayered unit embedded therein is also provided. More than one component of the downhole article can be an article having embedded multilayered units.

The multilayered units can also be disposed on a surface of an article. In an embodiment, a downhole assembly comprises a first component and a multilayered unit disposed on a surface of the first component. The downhole assembly further comprises a second component, and the multilayer unit is disposed between the first and second components. The first component, the second component, or both can comprise corrodible metallic material as disclosed herein. Exemplary downhole assemblies include frac plugs, bridge plugs, and the like.

Figure 6:
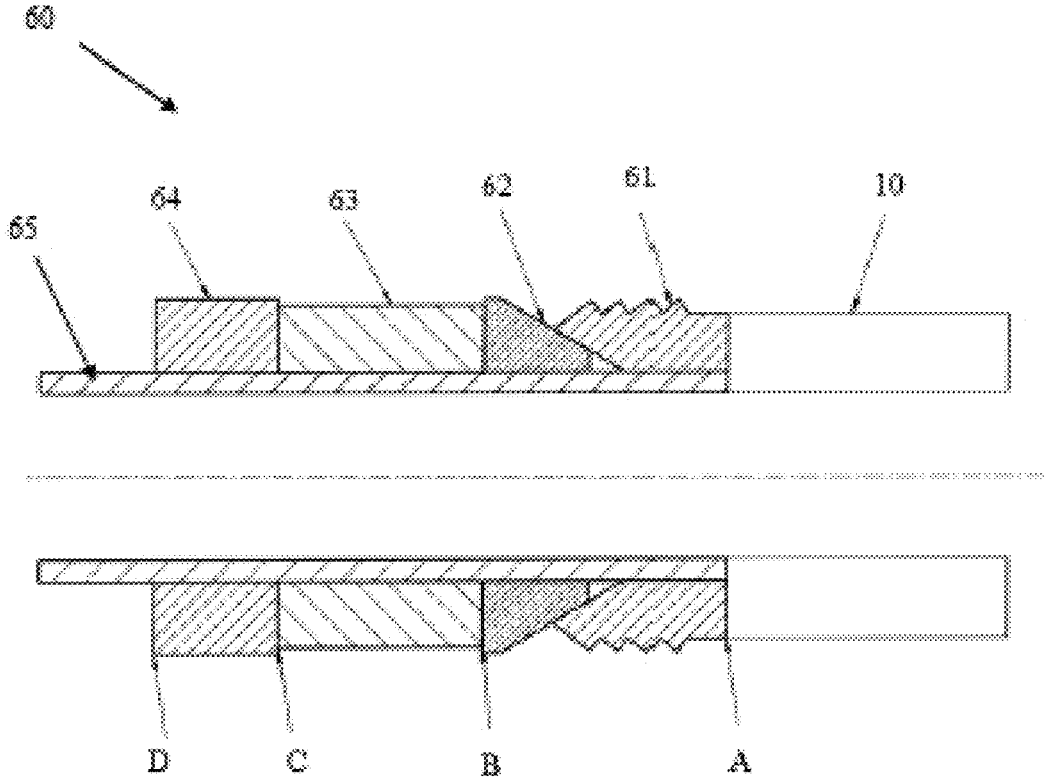
FIG. 6 illustrates a downhole assembly having a multilayered unit attached to a component of the assembly or disposed between adjacent components of the assembly.

FIG. 6 schematically illustrates a downhole assembly having a multilayered unit 10 attached to a component of the assembly or disposed between adjacent components of the assembly. As shown in FIG. 6, one embodiment of a downhole assembly 60 includes elements including an annular body 65 having a flow passage therethrough; a frustoconical element 62 disposed about the annular body 65; a sealing element 63 carried on the annular body 65 and configured to engage a portion of the frustoconical element 62; and a slip segment 61 and an abutment element 64 disposed about the annular body 65. While illustrated as individual elements, one or more of the elements of the downhole assembly 60 may be integrally combined, such as, but not limited to annular body 65 and frustoconical element 62. Further, other embodiments of the downhole assembly 60 may include additional elements as required for particular operations. One or more of the frustoconical element 62, sealing element 63, abutment element 64, and slip segment 61 can have one or more embedded units 10, such as multi-layered units 10, as disclosed herein. That is, the unit 10 can be integrally combined with any one or more of the elements of the downhole assembly 60. Alternatively or in addition, unit 10 can be disposed on a surface of the slip segment 61 (position A), disposed on a surface of abutment element 64 (position D), between frustoconical element 62 and sealing element 63 (position B) or between sealing member 63 and abutment element 64 (position C).

Figure 7:
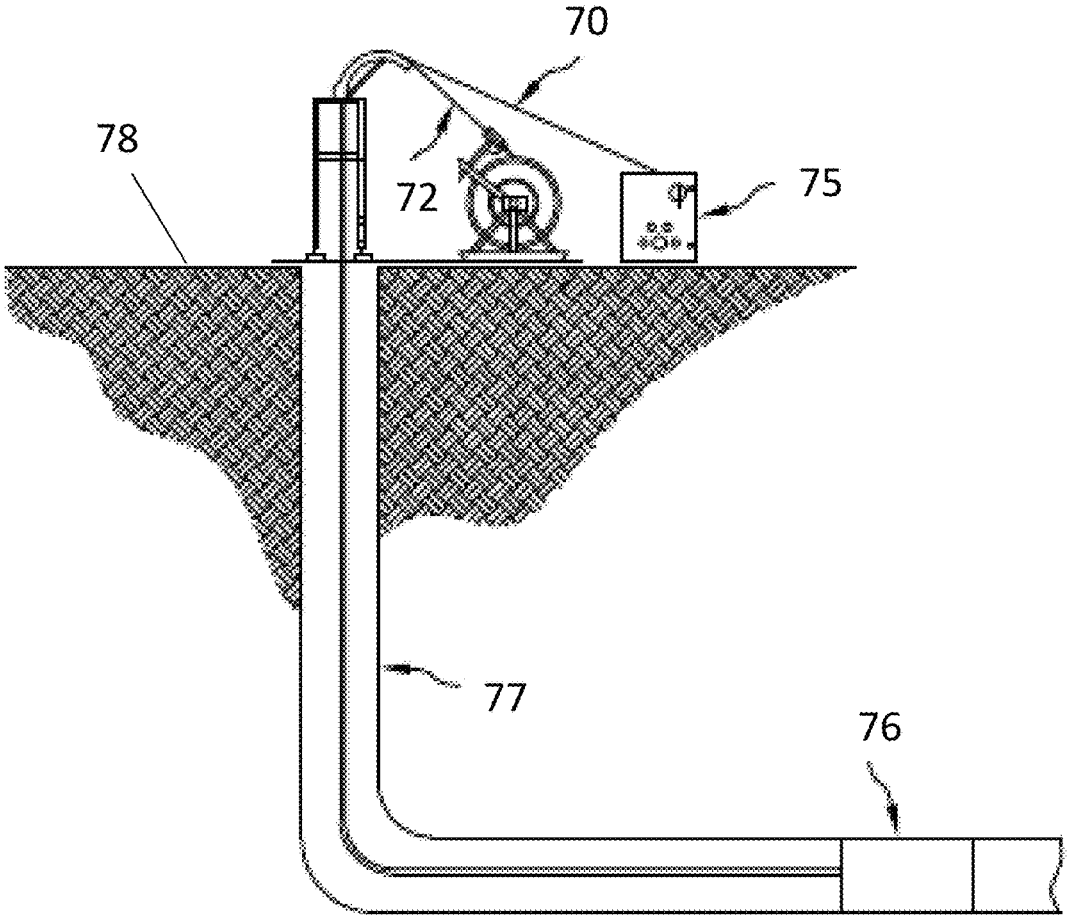
FIG. 7 is a schematic diagram illustrating a downhole assembly disposed in a downhole environment according to an embodiment of the disclosure.

Referring to FIG. 7, in one embodiment, a downhole assembly 76 is disposed in borehole 77 via a coil tubing or wireline 72. A communication line 70 couples the downhole assembly 76 to a processor 75. The communication line 70 can provide a command signal such as a selected form of energy from processor 75 to the downhole assembly 76 to activate the energetic material in the downhole assembly 76, such as by initiating activation of the activator 13 in at least one multi-layered unit 10 included in the downhole assembly 76. The communication line 70 can be optical fibers, electric cables or the like, and it can be placed inside of the coil tubing or wireline 72.

A method of controllably removing a downhole article or a downhole assembly comprises disposing a downhole article or a downhole assembly as described herein in a downhole environment; performing a downhole operation; activating the energetic material; and degrading, including full or partially disintegrating, the downhole article. A downhole operation can be any operation that is performed during drilling, stimulation, completion, production, or remediation. A fracturing operation is specifically mentioned. To start an on-demand degradation process, one multilayered unit is triggered and other units will continue the rapid degradation process following a series of sequenced reactions. The sequenced reactions might be triggered by pre-set timers in different units. Alternatively, the energetic material in one unit is activated and reacts to generate heat, strain, vibration, an acoustic signal or the like, which can be sensed by an adjacent unit and activate the energetic material in the adjacent unit. The energetic material in the adjacent unit reacts and generates a signal that leads to the activation of the energetic material in an additional unit. The process repeats and sequenced reactions occur.

Disintegrating the downhole article comprises breaking the downhole article into a plurality of discrete pieces. Advantageously, the discrete pieces can further corrode in the downhole fluid and eventually completely dissolve in the downhole fluid or become smaller pieces which can be carried back to the surface by wellbore fluids.

Figure 8A:
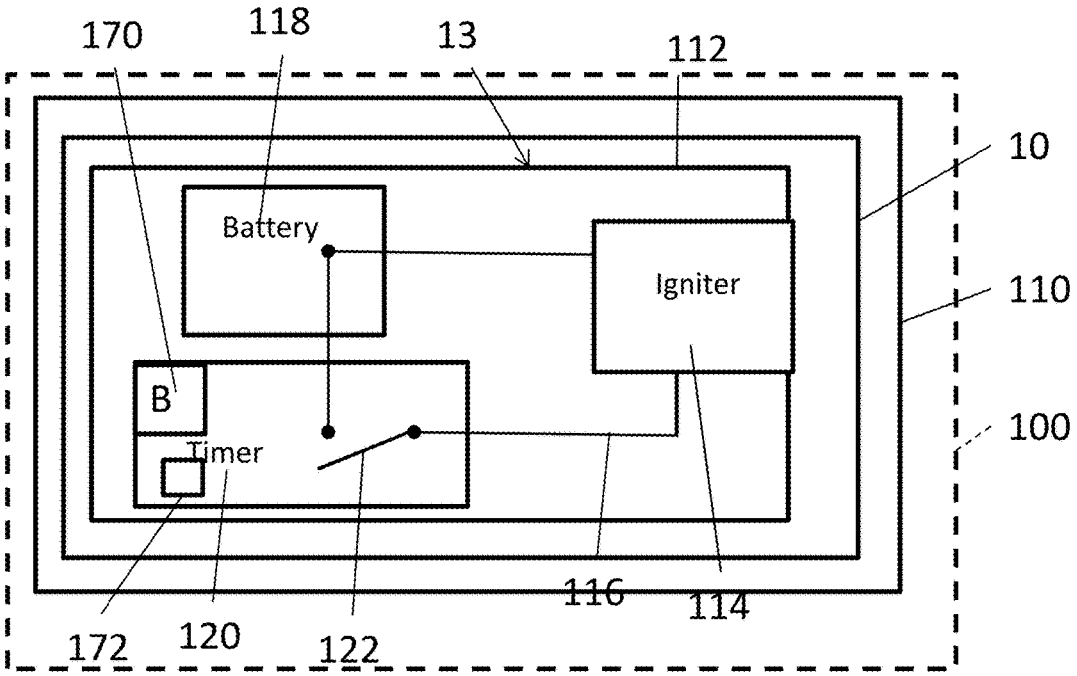
FIGS. 8A and 8B schematically illustrate an embodiment of an activator for the multilayered unit, the activator having a triggering system, where
Figure 8B:
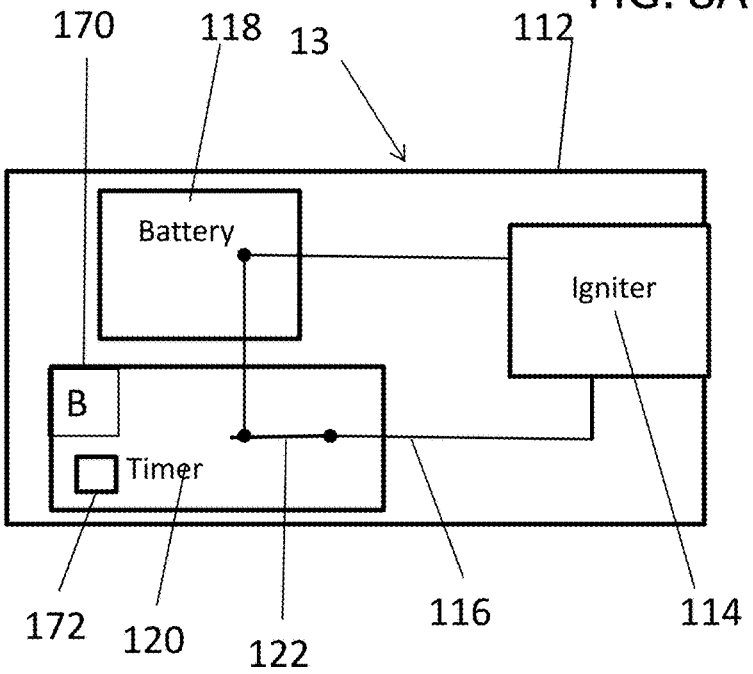

FIGS. 8A-8B illustrate an embodiment of an activator 13 for the unit 10, such as, but not limited to, multi-layered unit 10. The activator 13 includes a triggering system 112. The triggering system 112 provides for operator-selected initiation of the ignition of the degradable downhole article having the degradable-on-demand material having the matrix material and the energetic material as described in the previous embodiments or combination of previous embodiments. In one embodiment, the triggering system 112 is provided within the core 14 of the unit 10. To provide easier operator access to the triggering system 112, the triggering system 112 may be disposed in the core 14 after the core 14 is formed. For example, the core 14 of energetic material may be formed with a receiving area and the triggering system 112 may be inserted into the receiving area in the core 14. Alternatively, the unit 10 may be formed in sections, with the triggering system 112 insertable within a receiving area in the core 14 and the sections subsequently mated to trap the triggering system 112 therein. In a further embodiment, at least a portion of the triggering system 112 is accessible from an exterior of the unit 10 so that a movable object can engage with the triggering system 112, as will be further described below. The degradable downhole article may be a portion of a downhole tool 110 or may be an entire downhole tool 110, and a downhole assembly 100 may be further provided that incorporates the downhole tool 110. The degradable-on-demand material does not begin degradation until a desired time that is chosen by an operator (as opposed to a material that begins degradation due to conditions within the borehole 77). The energetic material as previously described is located in the core 14 which also contains the activator 13. The degradable-on-demand material may further include the above-noted matrix material (21, 31, 41, 51) in which one or more of the unit 10 is contained or otherwise in contact. In the following embodiments, the units 10 may include either a single layer covering the core 14 or multiple layers 11, 12 as previously described. The activator 13 is contained in at least one of the one or more units 10, and the units 10 are in contact with the matrix of the downhole tool 110. The downhole tool 110 with the multi-layered units 10 incorporated within the degradable-on-demand material is thus a self-contained package that can be run downhole, such that in one embodiment the downhole tool 110 need not be connected to surface, and the downhole tool 110 can serve a downhole function prior to degradation, including full or partial disintegration.

In one embodiment, the triggering system 112 includes an igniter 114 arranged to directly ignite the energetic material in the core 14. The igniter 114 may also directly ignite another material that then ignites the core 14. In either case, the core 14 is ignited. In the illustrated embodiment, the triggering system 112 further includes an electrical circuit 116. In FIG. 8A, the circuit 116 is open so that the igniter 114 is not activated, not provided with electric current, and thus does not ignite the energetic material. In FIG. 8B, the circuit 116 is closed so that battery 118 starts to provide electric current to activate and set off the igniter 114, which ignites the energetic material in the core 14 and thus initiates the degradation of the remainder of the degradable-on-demand material within the downhole tool 110. In some embodiments, closure of the circuit 116 occurs when the switch 122 closes the circuit 116. Closing the switch 122 may be controlled by a timer 120, or as will be further described below, may be closed by movement of an object downhole. The object is exterior of and separate from the triggering system 112. In an embodiment including the timer 120, while the battery 118 could be separately connected to the timer 120 for operation of the timer 120, the timer 120 preferably includes its own separate battery 170 so that the battery 118 is dedicated to the igniter 114 to ensure sufficient energy release at the time of ignition. The timer 120 can be pre-set at surface 78 (see FIG. 7) or can be pre-set any time prior to running the downhole assembly having the downhole tool within the borehole 77. Having the timer 120 within the self-contained package of the downhole tool 110 and 10 enables independence of physical connections to surface 78 with respect to control of the triggering system 112. While the timer 120 can be set to close the switch 122 after any pre-selected time period, in one embodiment, the timer 120 remains inactive and does not start the time period until an object is moved within the borehole 77, as will be further described below. Once the timer 120 is initiated, such as by a physical engagement with a start switch 172 which will begin the timer 120, the time period commences. The time period may be set such that the switch 122 closes after the expected completion of a procedure in which the downhole tool 110 is utilized. In the embodiment where the timer 120 is inactive until a predetermined physical activity occurs within the borehole 77, the timer 120 is programmed to have a time period to close switch 122 from about the time the object is moved to the time the downhole tool 110 has completed a downhole procedure. Once the downhole tool 110 is no longer required, the circuit 116 can be closed in order to permit the battery 118 to provide electric current to set off the igniter 114. As demonstrated by FIG. 8B, once the circuit 116 is in the closed condition, and igniter 114 is activated, heat is generated, and the degradable article within the downhole tool 110 breaks into small pieces, such as an energetic material and a matrix material. The degradation of the downhole tool 110 is controlled and gradual, as opposed to a rupture or detonation that may uncontrollably direct pieces of the degraded downhole tool 110 forcefully into other remaining downhole structures.

Figure 9:
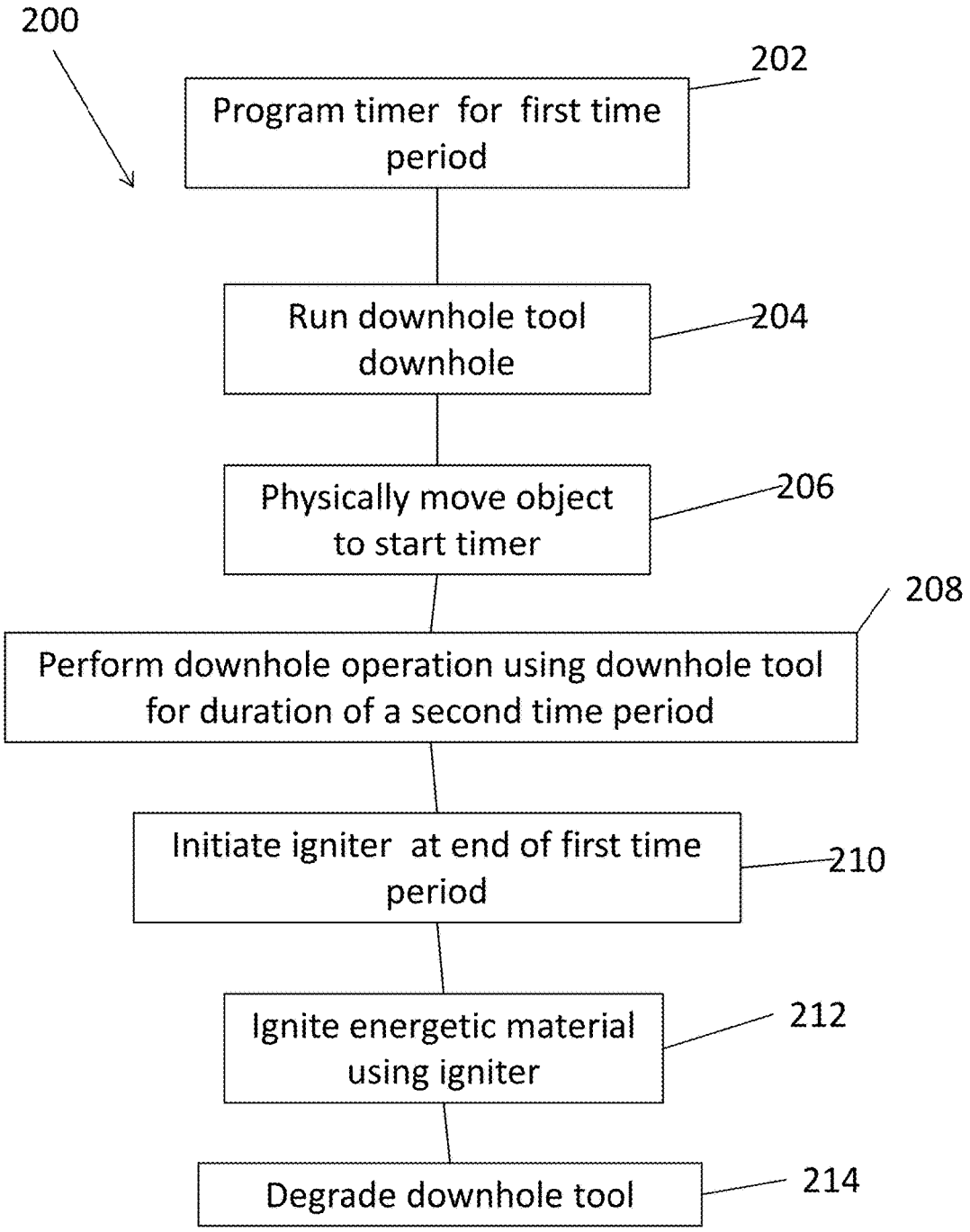
FIG. 9 is a flowchart of an embodiment of a method of degrading a downhole tool.

FIG. 9 is a flowchart of an embodiment of a method 200 of employing the triggering system 112 to degrade the downhole tool 110 of the downhole assembly 100. As indicated by box 202, in embodiments including the timer 120, the timer 120 is set by an operator or by a manufacturer, however the timer 120 remains inactive (the timer is not yet started) at this stage. As indicated by box 204, the downhole tool 110 is run downhole within borehole 77. The downhole tool 110 may be attached to any other equipment, tubing string, and other downhole tools that form the entirety of the downhole assembly 100. As indicated by box 206, a physical activity occurs within the borehole 77 that starts the timer 120. In particular, an object is moved that starts the timer 120. In one embodiment, the object may directly or indirectly engage with the start switch 172 of the timer 120 to start the timer 120. While the timer 120 is running (and while the electric circuit 116 remains open), a downhole operation using the downhole tool 110 is performed, as indicated by box 208. The utilization of the downhole tool 110 may occur for the duration of a second time period. At the conclusion of the first time period, the electrical circuit 116 is closed so that the igniter 114 is initiated, as indicated by box 210. The conclusion of the first time period may be after the conclusion of the second time period (after the end of the downhole operation). As indicated by box 212, once the igniter 114 is active, the energetic material is ignited and activated, which, as indicated by box 214, leads to degradation of the downhole tool 110.

Figure 10:
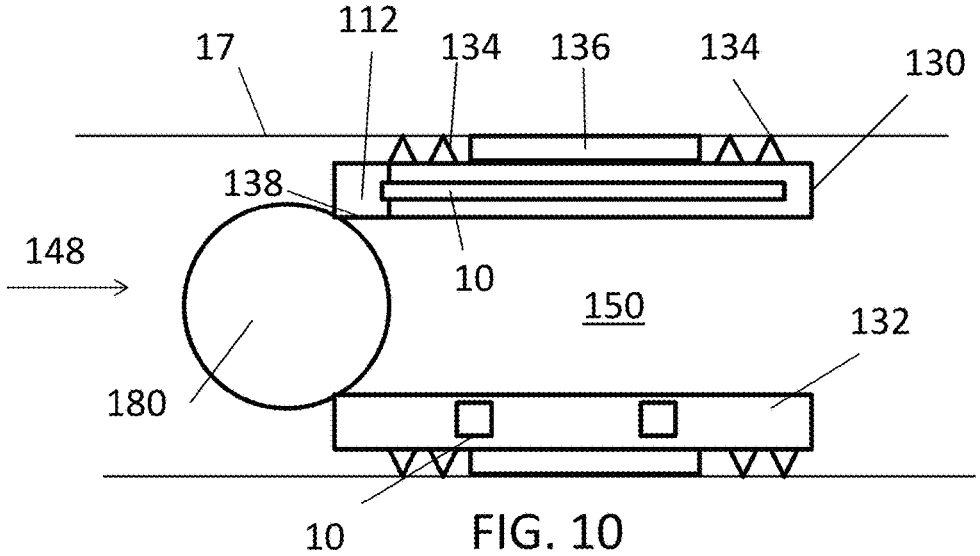
FIG. 10 schematically illustrates an embodiment of a frac plug as one embodiment of the downhole tool to degrade.

FIG. 10 illustrates one embodiment of a downhole tool 110 that may be utilized in the method 200. The downhole tool 110 is a frac plug 130. The frac plug 130 includes a body 132, slips 134, and a resilient member 136. The triggering system 112 of the unit 10 is illustrated as disposed at an uphole end of the frac plug 130, such as at a ball seat 138 of the frac plug 130. The unit 10 may be attached to or embedded within the frac plug 130, which includes the matrix material. In one embodiment, a plurality of units 10 are included in the frac plug 130. One or more of the units 10 may extend longitudinally along a length of the body 132 such that when the igniter 114 in the triggering system 112 is ignited, the energetic material is quickly activated across a span of the frac plug 130. In one embodiment, the unit 10 may additionally include a helical shape such that the energetic material is quickly activated across a large portion of the frac plug in both circumferential and longitudinal directions. At surface 78, the slips 134 and resilient member 136 have a first outer diameter which enables the frac plug 130 to be passed through the borehole 77. When the frac plug 130 reaches a desired location within the borehole 77, the frac plug 130 is set, such as by using a setting tool (not shown), to move the slips 134 radially outwardly to engage with an inner surface of the borehole 77 (or casing) to prevent longitudinal movement of the frac plug 130 with respect to the borehole 77. At the same time, the resilient member 136 sealingly engages with the inner surface of borehole 77 (or casing). In embodiments having the timer 120, the timer 120 in the triggering system 112 is inactive when the frac plug 130 is run downhole. To prevent flow through flowbore 150 in a downhole direction 148, so as to provide a pressure increase uphole of the frac plug 130, a frac ball 180 is landed on the frac plug 130. In particular, the frac ball 180 lands on seat 138. The landed frac ball 180 also engages with the triggering system 112, and the start switch 172 of the timer 120 is closed so that the timer 120 is started.

When the frac plug 130 is no longer needed, such as after the completion of a plug and perf operation, the triggering system 112 ignites the frac plug 130 after the time period set within timer 120 ends, closes switch 122, and activates the igniter 114. Alternatively, when the triggering system 112 does not include the timer 120, the landed frac ball 180 engages with the triggering system 112 to close the switch 122, or otherwise close the electrical circuit 116, thus activating the igniter 114 to ignite the frac plug 130 at least substantially immediately. In such an embodiment, the degradable-on-demand material would be designed to stay at least substantially intact until an end of the frac operation. That is, while the degradable-on-demand material may be ignited upon landing of the frac ball 180, the degradation of the frac plug 130 would be slow enough to complete the frac operation before losing integrity of the frac plug 130. In one embodiment, only select portions of the frac plug 130 are formed of the above-described degradable-on-demand material, such as, but not limited to the body 132. In another embodiment, other portions of the frac plug 130 are not formed of the degradable-on-demand material, however, such other portions may be formed of a different degradable material, such as the matrix material without a unit having energetic material, that can be effectively and easily removed once the degradable article made of the degradable-on-demand material of the frac plug 130 has been substantially disintegrated during the degradation of the degradable article within the frac plug 130. When only one part of the frac plug 130 is made of degradable-on-demand material, such as, but not limited to the body 132 or cone (such as frustoconical element 62 shown in FIG. 6), the degradation of that part will eliminate the support to the other components such as, but not limited to, the slip 134. In this way, the frac plug 130 can collapse off from the casing to remove obstacle to flow path on-demand; in addition, degradable-on-demand material generates heat which can speed up the degradation of the rest of the frac plug 130.

Figure 11:
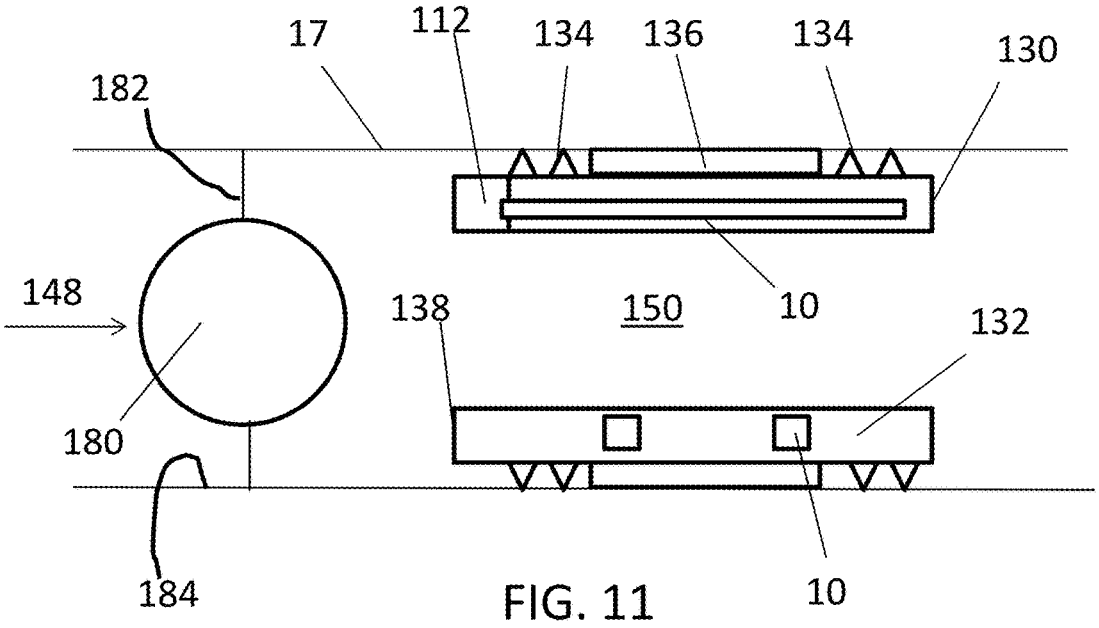
FIG. 11 schematically illustrates an embodiment of a frac plug as another embodiment of the downhole tool to degrade.

In one embodiment of FIG. 10, the timer 120 is started when the ball 180 lands on the frac plug 130. To ensure that the landed frac ball 180 successfully starts the timer 120, FIG. 11 illustrates an embodiment where the frac ball 180 is retained in the borehole 77 by one or more shear wires 182 that suspend the frac ball 180 within the borehole 77. The shear wires 182 may extend from the frac ball 180 to a liner or other tubular 184 that extends through the borehole 77. Alternatively, the frac plug 130 may include an extension (not shown) that supports the frac ball 180 uphole of the frac plug 130 using shear wires 182. In either embodiment, flow through the flowbore 150 is still enabled with the frac ball 180 retained in such a manner as the frac ball 180 and shear wires 182 do not entirely block fluid flow. The shear wires 182 can be configured to break and release the frac ball 180 at the beginning of a frac operation when frac pressure from frac fluids are directed forcefully in the downhole direction 148 towards the frac ball 180. With the frac ball 180 free from the connected shear wires 182, the frac ball 180 is pushed by the frac pressure and forcefully lands on the ball seat 138 and the timer 120 in the triggering system 112 is started. Degradation of the frac plug 130 may then occur subsequent the completion of the frac operation as in the previous embodiment. Alternatively, the landed frac ball 180 may close the switch 122, or otherwise close the electrical circuit 116, to activate the igniter 114 and begin degradation of the frac plug 130 as previously described with respect to an embodiment described with respect to FIG. 10.

Figure 12:
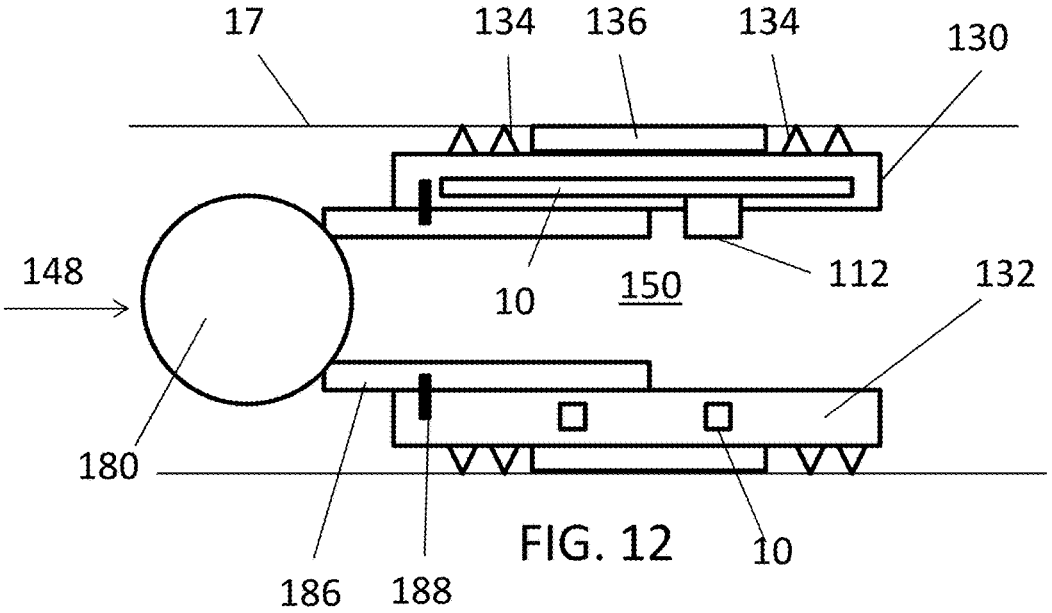
FIG. 12 schematically illustrates an embodiment of a frac plug as another embodiment of the downhole tool to degrade.

In the FIGS. 10 and 11 embodiments, the timer 120 in the triggering system 112 is started, or the switch 122 is immediately closed, due to the landing of the frac ball 180 on the frac plug 130. FIG. 12 illustrates another embodiment of a frac plug 130. In this embodiment, a sleeve 186 is shear pinned using pins 188 to the interior of the frac plug 130. An uphole end of the sleeve 186 receives the frac ball 180. When a predetermined pressure is reached, such as a frac pressure, the frac ball 180 forcibly moves the sleeve 186 in the downhole direction 148. Downhole movement of the sleeve 186 and frac ball 180 may be limited by a shoulder within the frac plug 130 that prevents downhole progress. Movement of the sleeve 186 starts the timer 120 in the triggering system 112, or alternatively closes the switch 122. The triggering system 112 of the multi-layered unit 10 is positioned to be engaged by the moving sleeve 86, such as on an interior surface of the frac plug 130. Since the pressure to move the sleeve 186 is frac pressure, the time period programmed in the timer 120 may be set to be approximately longer than an expected frac operation. Degradation of the frac plug 130 may then occur subsequent the completion of the frac operation as in the previous embodiment. Both the frac plug 130 and the sleeve 186 may include degradable-on-demand materials.

Figure 13:
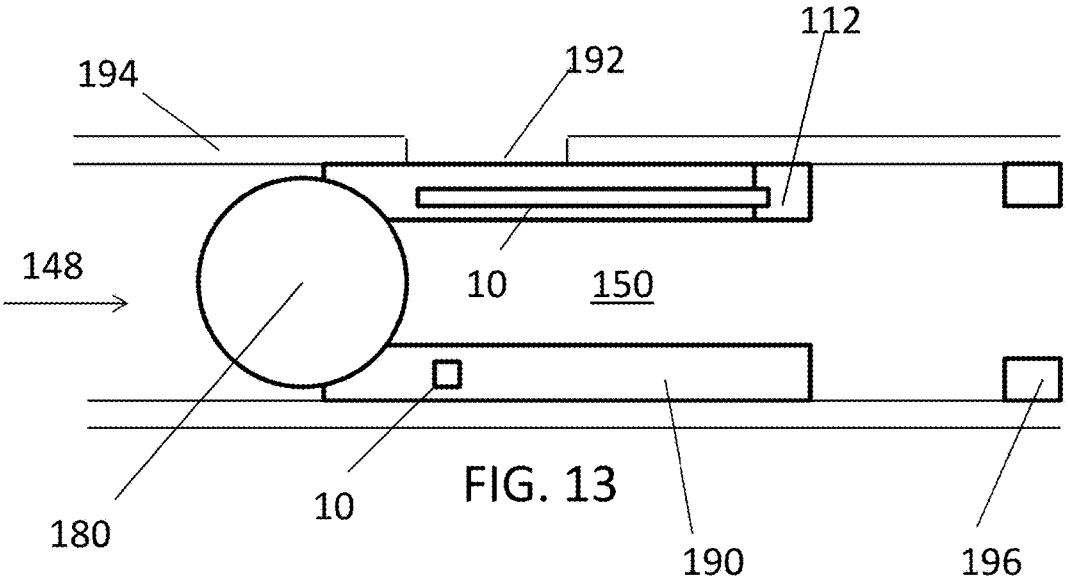
FIG. 13 schematically illustrates an embodiment of a slidable sleeve as another embodiment of the downhole tool to degrade.

While FIGS. 10-12 illustrate variations of a frac plug 130 as a downhole tool that can be degraded using the method 200 shown in FIG. 9, FIG. 13 shows an alternate downhole tool that can be employed in the method 200. Sliding sleeve 190 covers a port 192 in a tubular 194. The sliding sleeve 190 may be shifted in the downhole direction 148 after a ball 180 lands on an uphole end of the sliding sleeve 190 and pressure is applied in the tubular 194 uphole of the ball 180. Frac fluids can then exit the port 192, or production fluids can enter the port 192. The shifting of the sleeve 190 abuts the triggering system 112 of the multi-layered unit 10 positioned at a downhole end of the sleeve 190, into a radially protruding shoulder 196 which starts the timer 120, or alternatively closes the switch 122 immediately. When the switch 122 is closed, either immediately or when the time period programmed in the timer 120 ends, the igniter 114 is activated to ignite the energetic material of the multi-layered unit 10 and degrade the matrix material of the sliding sleeve 190. The ball may fall to a lower sleeve, degrade, or be delivered to surface. Removal of the sliding sleeve 190 opens the flowbore 150 for greater production diameter.

Figure 14:
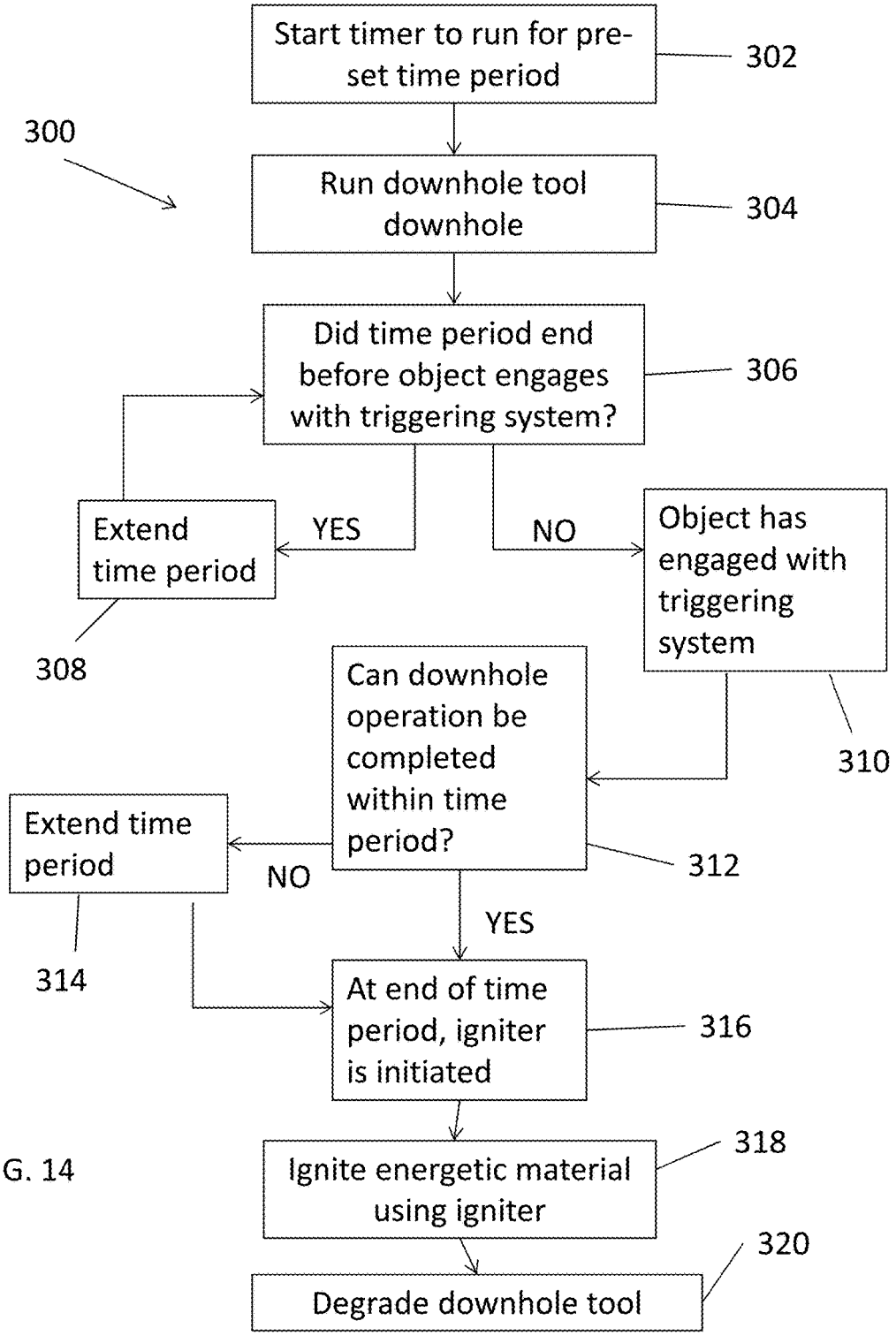
FIG. 14 is a flowchart of another embodiment of a method of degrading a downhole tool; and, FIG. 15 schematically illustrates an embodiment of a frac plug as another embodiment of the downhole tool to degrade.

FIG. 14 depicts a flowchart of a method of degrading the downhole tool in alternative embodiments. As indicated by box 302, the timer 120 is set at surface 78 or an alternative location with an initial preset value and started on surface, and then the downhole tool 110 is run downhole as indicated by box 304. In these embodiments, the triggering time (the time when the circuit 116 is closed) may be delayed or changed if an expected event does not happen by a certain time within the preset value, or does not happen at all. For example, if the timer 120 is set for 10 hours, but at the end of the 10 hours the ball 180 has still not landed on the frac plug 130, then a program will initiate to extend the time period. Thus, box 306 queries whether the time period has ended before the object has engaged with the triggering system 112, and box 308 indicates that the time period is extended when the time period has ended before the object engages with the triggering system 112. At the end of the extended time period, if the moving object event still has not occurred, then the program will repeat to extend the time period, and will continually repeat as long as the moving object event has not occurred. If the object has engaged with the triggering system, as indicated by box 310, then box 312 queries whether or not the downhole operation can be completed within the time period. For example, if the ball 180 lands at 9 hours into a 10 hour time period, and a frac operation is expected to take longer than one hour, then the time period for closing the circuit 116 is extended, as indicated by box 314, since it may be undesirable to initiate degradation of the downhole tool 110 prior to completion of the downhole procedure. The extension of the time period can be calculated within a controller within the timer 120 or elsewhere in the triggering system 112, taking into account whether or not the moving object event has occurred (box 306), and if it has, at what time within the original time period (box 312). In such embodiments, instead of the moving object (such as, but not limited to, frac ball 180, sleeve 186, and sleeve 190) serving to start the timer 120 in the triggering mechanism 112, the moving object engages with the triggering system 112 to initiate a computer program within controller that determines whether the igniter 114 can be activated at the end of the time period or whether an extension should be calculated. Once it has been deemed that the downhole operation can be completed within the time period, then at the end of the time period, as indicated by box 316, the switch 122 will close the circuit 116, the igniter 114 will be initiated and the energetic material within the multi-layered unit 10 will be ignited, as indicated by box 318, to degrade the downhole tool 110, as indicated by box 320.

Figure 15:
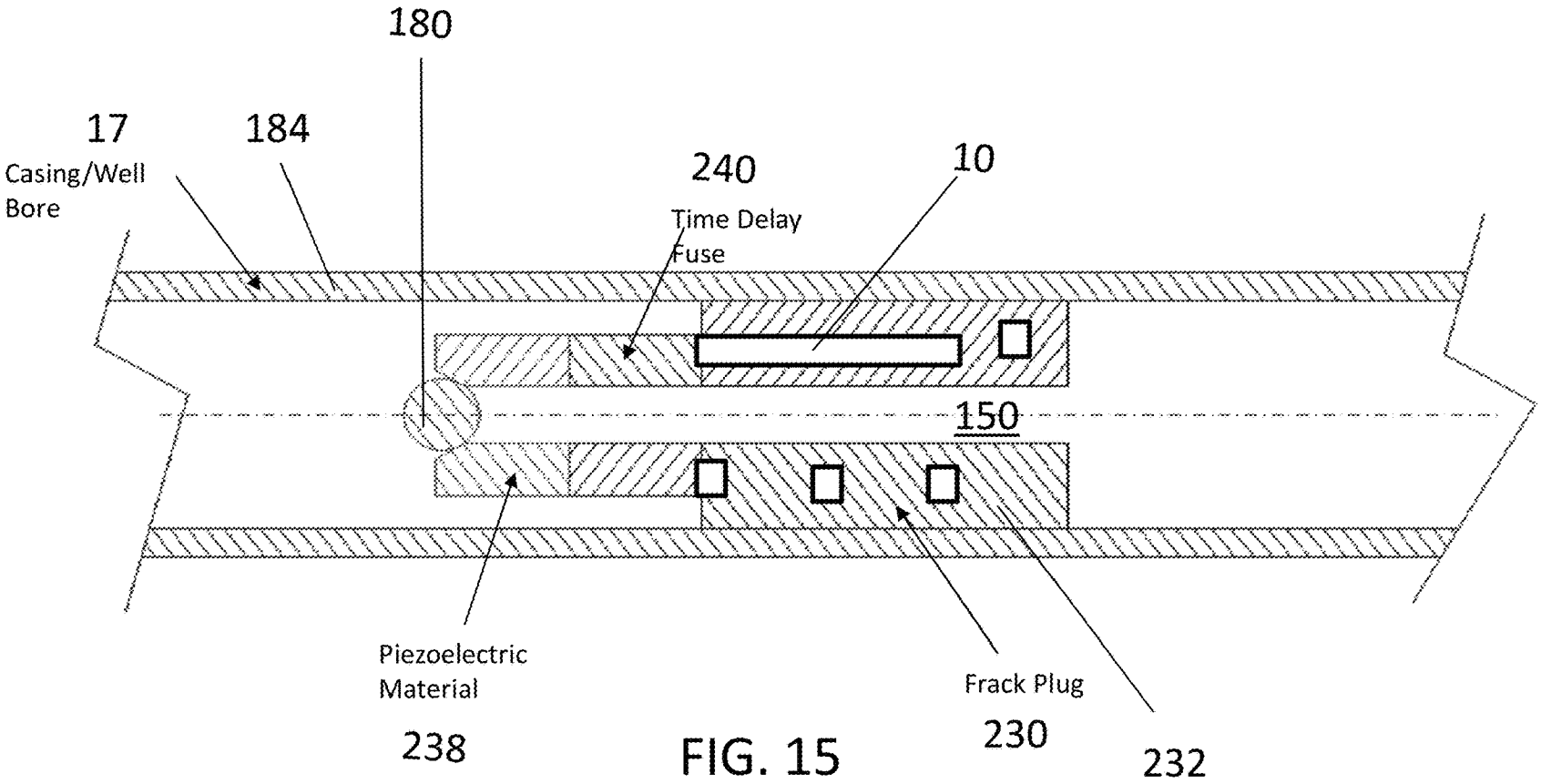

With reference now to FIG. 15, another embodiment of a degradable frac plug 230 is shown. The frac plug 230 includes a body 232 made of the degradable-on-demand material including at least the matrix material and the energetic material within a modified unit 250. The unit 250 may include the layers as previously described with respect to unit 10, but need not include the activator 13 as in the unit 10. Although not shown in FIG. 15, the frac plug 230 may include slips and a resilient member as shown in FIGS. 10-12. To initiate ignition and activation of the energetic material in the unit 250, a frac ball 180 is landed on a ball seat 238 formed of a piezoelectric material. When pressure in the borehole 77 is increased, such as to frac pressure, the piezoelectric material of the ball seat 238 is ruptured and creates a spark which ignites the time delay fuse 240. Both the ball seat 238 and the time delay fuse 240 share the flowbore 150 with the body 232 of the frac plug 230. Since the frac plug 230 is needed for the duration of a frac operation, the time delay fuse 240 is provided with appropriate dimensions and slow-burning materials necessary to delay ignition of the energetic material within the unit 250 for a predetermined amount of time. By example only, the time delay fuse 240 may take approximately five hours to burn prior to igniting the unit 250. Thus, the time delay fuse 240 operates as a timer in this embodiment, where the timer is activated to start upon movement of a downhole object, in this case the frac ball 180. When the frac plug 230 is finally ignited, the frac operation is already completed and the frac plug 230 can be degraded.

In one embodiment, only select portions of the frac plug 130, 230 are formed of the above-described degradable-on-demand material, such as, but not limited to the body 132. In another embodiment, other portions of the frac plug 130 are not formed of the degradable-on-demand material, however, such other portions may be formed of a different degradable material that can be effectively and easily removed once the degradable article made of the degradable-on-demand material of the frac plug 130 has been degraded or during the degradation of the degradable article within the frac plug 130. When only one part of the frac plug 130, 230 is made of degradable-on-demand material, such as, but not limited to the body 132 or cone (such as frustoconical element 62 shown in FIG. 6), the degradation of that part may eliminate the support to the other components, such as, but not limited to, the slip 134. In this way, the frac plug 130, 230 can collapse off from the casing to remove obstacle to flow path on-demand; in addition, degradable-on-demand material generates heat which can speed up the degradations of the rest of the frac plug 130, 230.

Various embodiments of the disclosure include a downhole article including: a matrix; and a multilayered unit disposed in the matrix, the multilayered unit including: a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer. In any prior embodiment or combination of embodiments, the multilayered unit has at least one stress concentration location. In any prior embodiment or combination of embodiments, the matrix has a pre-crack around the multilayered unit. In any prior embodiment or combination of embodiments, the activator is a device that is effective to generate spark, electrical current, or a combination thereof to active the energetic material. In any prior embodiment or combination of embodiments, the energetic material includes a thermite, a thermate, a solid propellant fuel, or a combination including at least one of the foregoing. In any prior embodiment or combination of embodiments, the metallic material includes Zn, Mg, Al, Mn, iron, an alloy thereof, or a combination comprising at least one of the foregoing. In any prior embodiment or combination of embodiments, the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination including at least one of the foregoing. In any prior embodiment or combination of embodiments, the support layer includes the metallic material; and the protective layer includes the polymeric material. In any prior embodiment or combination of embodiments, the support layer includes the polymeric material; and the protective layer includes the metallic material. In any prior embodiment or combination of embodiments, the core is present in an amount of 5 to 80 vol %, the support layer is present in an amount of 20 to 95 vol %, and the protective layer is present in an amount of 0.1 to 20 vol %, each based on the total volume of the multilayered unit. In any prior embodiment or combination of embodiments, a downhole assembly includes the downhole article.

Various embodiments of the disclosure further include a downhole assembly including a first component and a multilayered unit disposed on a surface of the first component, the multilayered unit including: a core comprising an energetic material and an activator; a support layer disposed on the core; and a protective layer disposed on the support layer, wherein the support layer and the protective layer each independently includes a polymeric material, a metallic material, or a combination comprising at least one of the foregoing, provided that the support layer is compositionally different from the protective layer. In any prior embodiment or combination of embodiments, the downhole assembly further includes a second component, and the multilayer unit is disposed between the first and second components. In any prior embodiment or combination of embodiments, the activator is a device that is effective to generate spark, electrical current, or a combination thereof to active the energetic material. In any prior embodiment or combination of embodiments, the first component, the second component, or both include Zn, Mg, Al, Mn, an alloy thereof, or a combination comprising at least one of the foregoing. In any prior embodiment or combination of embodiments, the multilayered unit has at least one stress concentration location. In any prior embodiment or combination of embodiments, the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination including at least one of the foregoing.

Various embodiments of the disclosure further include a method of controllably removing a downhole article, the method including: disposing a downhole article of any one of the previous embodiments in a downhole environment; performing a downhole operation; activating the energetic material; and disintegrating the downhole article. In any prior embodiment or combination of embodiments, disintegrating the downhole article comprises breaking the downhole article into a plurality of discrete pieces; and the method further includes corroding the discrete pieces in a downhole fluid. In any prior embodiment or combination of embodiments, activating the energetic material includes triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

Various embodiments of the disclosure further include a method of controllably removing a downhole assembly, the method including: disposing a downhole assembly of any one of the previous embodiments in a downhole environment; performing a downhole operation; activating the energetic material in the multilayered unit; and disintegrating the downhole assembly. In any prior embodiment or combination of embodiments, disintegrating the downhole assembly comprises breaking the downhole assembly into a plurality of discrete pieces; and the method further includes corroding the discrete pieces in a downhole fluid. In any prior embodiment or combination of embodiments, activating the energetic material comprises triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

Set forth below are various embodiments of the disclosure.

Embodiment 1

A downhole assembly includes a downhole tool including a degradable-on-demand material including: a matrix material; and, a unit in contact with the matrix material. The unit includes a core including an energetic material configured to generate energy upon activation to facilitate degradation of the downhole tool; and, an activator disposed in contact with the core, the activator including a triggering system having an electrical circuit and an igniter within the electrical circuit, the electrical circuit having an open condition and a closed condition, the electrical circuit configured to be in the closed condition after movement of an object downhole that engages directly or indirectly with the triggering system, and the igniter arranged to ignite the energetic material in the closed condition of the electrical circuit. In the open condition of the electrical circuit the igniter is inactive, and in the closed condition of the electrical circuit the igniter is activated.

Embodiment 2

The downhole assembly as in any prior embodiment or combination of embodiments, further including a switch in the triggering system, the switch arranged to close in response to movement of the object downhole.

Embodiment 3

The downhole assembly as in any prior embodiment or combination of embodiments, wherein closure of the switch closes the electrical circuit.

Embodiment 4

The downhole assembly as in any prior embodiment or combination of embodiments, further including a timer configured to be initiated in response to the movement of the object downhole, wherein the switch is a start switch of the timer, and the degradable-on-demand material is ignited by the igniter after a time period set by the timer ends.

Embodiment 5

The downhole assembly as in any prior embodiment or combination of embodiments, wherein the start switch is a first switch, and further including a second switch within the electrical circuit, the second switch configured to close the electrical circuit at the end of the time period set by the timer.

Embodiment 6

The downhole assembly as in any prior embodiment or combination of embodiments, wherein the downhole tool is a frac plug and the object includes a frac ball, and the switch is engaged by the frac ball when the frac ball lands on the frac plug.

Embodiment 7

The downhole assembly as in any prior embodiment or combination of embodiments, wherein the frac ball is tethered to a tubular uphole of the frac plug, and frac fluid pressure forces the frac ball onto the frac plug.

Embodiment 8

The downhole assembly as in any prior embodiment or combination of embodiments, wherein the object further includes a shifting sleeve shear pinned to the frac plug, and the shifting sleeve is sheared from the frac plug and moved to engage with the switch in response to frac fluid pressure that forces the shifting sleeve, with the frac ball seated thereon, to move downhole.

Embodiment 9

The downhole assembly as in any prior embodiment or combination of embodiments, wherein the downhole tool is a sliding sleeve and the object is a ball used to shift the sliding sleeve, and the switch is closed by sliding the sliding sleeve into a stationary shoulder.

Embodiment 10

The downhole assembly as in any prior embodiment or combination of embodiments, wherein the downhole tool is a frac plug, a first component of the frac plug is formed of the degradable-on-demand material, and a second component of the frac plug is formed of the matrix material, the second component not including the energetic material, and the second component in contact with the first component.

Embodiment 11

The downhole assembly as in any prior embodiment or combination of embodiments, wherein the electrical circuit further includes a battery, the battery arranged to provide electric current to set off the igniter in the closed condition of the circuit.

Embodiment 12

The downhole assembly as in any prior embodiment or combination of embodiments, wherein the unit further includes at least one layer disposed on the core.

Embodiment 13

The downhole assembly as in any prior embodiment or combination of embodiments, wherein the unit is a multi-layered unit and the at least one layer includes a support layer disposed on the core; and a protective layer disposed on the support layer, the support layer interposed between the core and the protective layer, wherein the support layer and the protective layer each independently comprises a polymeric material, a metallic material, or a combination comprising at least one of the foregoing, provided that the support layer is compositionally different from the protective layer.

Embodiment 14

The downhole assembly as in any prior embodiment or combination of embodiments, wherein the protective layer has a lower corrosion rate than the support layer.

Embodiment 15

The downhole assembly as in any prior embodiment or combination of embodiments, wherein the matrix material has a cellular nanomatrix, a plurality of dispersed particles dispersed in the cellular nanomatrix, and a solid-state bond layer extending through the cellular nanomatrix between the dispersed particles.

Embodiment 16

A method of controllably removing the downhole tool of the downhole assembly as in any prior embodiment or combination of embodiments, the method including: disposing the downhole assembly in a downhole environment; moving the object downhole to engage with the downhole tool and close a switch in the triggering system; performing a downhole operation using the downhole assembly; activating the energetic material using the igniter; and degrading the downhole tool.

Embodiment 17

The method as in any prior embodiment or combination of embodiments, wherein closing the switch starts a timer in the triggering system, and activating the energetic material using the igniter occurs at an end of a time period set in the timer.

Embodiment 18

The method as in any prior embodiment or combination of embodiments, wherein moving the object downhole includes landing a frac ball on a frac plug.

Embodiment 19

The method as in any prior embodiment or combination of embodiments, wherein moving the object downhole includes landing a ball on a sleeve and shifting the sleeve.

Embodiment 20

A method of controllably removing a downhole tool of a downhole assembly, the method including: starting a timer in a triggering system of the downhole assembly for a pre-selected time period, the downhole tool including degradable-on-demand material having a matrix material and an energetic material configured to generate energy upon activation to facilitate degradation of the downhole tool; disposing the downhole assembly in a downhole environment; determining if a downhole operation can be completed within the pre-selected time period, and extending the pre-selected time period to an extended time period if the downhole operation cannot be completed within the pre-selected time period; performing the downhole operation using the downhole assembly; activating the energetic material at an end of the pre-selected time period or at an end of the extended time period using the igniter; and degrading the downhole tool.

Embodiment 21

The method as in any prior embodiment or combination of embodiments, further comprising determining if an object usable in the downhole operation has engaged with the triggering system, and extending the pre-selected time period if the object has not engaged with the triggering system.

Embodiment 22

The method as in any prior embodiment or combination of embodiments, wherein the object is a ball and the downhole tool is one of a frac plug and a sliding sleeve.

Embodiment 23

A frac plug including a body formed of a degradable-on-demand material, the degradable-on-demand material including: a matrix material; and, a unit in contact with the matrix material, the unit including: a core comprising an energetic material configured to generate energy upon activation to facilitate the degradation of the downhole tool; and, at least one layer disposed on the core; a time delay fuse in contact with an uphole end of the body and in contact with the energetic material; and, a ball seat including a piezoelectric material at an uphole end of the time delay fuse;

wherein the piezoelectric material is configured to create a spark and ignite the time delay fuse after a ball is seated on the ball seat and pressure is increased on the ball in a downhole direction.

Embodiment 24

The frac plug as in any prior embodiment or combination of embodiments wherein the at least one layer includes a protective layer and a support layer, the support layer disposed between the protective layer and the core, the support layer compositionally different than the protective layer.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity). Further, it should further be noted that the terms "first," "second," and the like herein do not denote any order, quantity, or importance, but rather are used to distinguish one element from another.

The teachings of the present disclosure apply to downhole assemblies and downhole tools that may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole assembly comprising:

a downhole tool including a degradable-on-demand material, the degradable-on-demand material including:

a matrix material; and, a unit in contact with the matrix material, the unit including:

a core comprising an energetic material configured to generate energy upon activation to facilitate degradation of the downhole tool; and, an activator disposed in contact with the core, the activator including a triggering system having an electrical circuit and an igniter within the electrical circuit, the electrical circuit having an open condition and a closed condition, the electrical circuit configured to be in the closed condition after movement of an object downhole, with respect to the downhole tool, that engages directly or indirectly with the triggering system, the igniter arranged to ignite the energetic material in the closed condition of the electrical circuit;

wherein, in the open condition of the electrical circuit the igniter is inactive, and in the closed condition of the electrical circuit the igniter is activated.

2. The downhole assembly of claim 1, further comprising a switch in the triggering system, the switch arranged to close in response to movement of the object downhole.

3. The downhole assembly of claim 2, wherein closure of the switch closes the electrical circuit.

4. The downhole assembly of claim 2, further comprising a timer configured to be initiated in response to the movement of the object downhole, wherein the switch is a start switch of the timer, and the degradable-on-demand material is ignited by the igniter after a time period set by the timer ends.

5. The downhole assembly of claim 4, wherein the start switch is a first switch, and further comprising a second switch within the electrical circuit, the second switch configured to close the electrical circuit at the end of the time period set by the timer.

6. The downhole assembly of claim 2, wherein the downhole tool is a frac plug and the object includes a frac ball, and the switch is engaged by the frac ball when the frac ball lands on the frac plug.

7. The downhole assembly of claim 6, wherein the frac ball is tethered to a tubular uphole of the frac plug, and frac fluid pressure forces the frac ball onto the frac plug.

8. The downhole assembly of claim 2, wherein the object further includes a shifting sleeve shear pinned to the frac plug, and the shifting sleeve is sheared from the frac plug and moved to engage with the switch in response to frac fluid pressure that forces the shifting sleeve, with the frac ball seated thereon, to move downhole.

9. The downhole assembly of claim 2, wherein the downhole tool is a sliding sleeve and the object is a ball used to shift the sliding sleeve, and the switch is closed by sliding the sliding sleeve into a stationary shoulder.

10. The downhole assembly of claim 1, wherein the downhole tool is a frac plug, a first component of the frac plug is formed of the degradable-on-demand material, and a second component of the frac plug is formed of the matrix material, the second component not including the energetic material, and the second component in contact with the first component.

11. The downhole assembly of claim 1, wherein the electrical circuit further includes a battery, the battery arranged to provide electric current to set off the igniter in the closed condition of the circuit.

12. The downhole assembly of claim 1, wherein the unit further includes at least one layer disposed on the core.

13. The downhole assembly of claim 12, wherein the unit is a multi-layered unit and the at least one layer includes a support layer disposed on the core; and a protective layer disposed on the support layer, the support layer interposed between the core and the protective layer, wherein the support layer and the protective layer each independently comprises a polymeric material, a metallic material, or a combination comprising at least one of the foregoing, provided that the support layer includes a different material from the protective layer.

14. The downhole assembly of claim 13, wherein the protective layer has a lower corrosion rate than the support layer.

15. The downhole assembly of claim 13, wherein the matrix material has a cellular nanomatrix, a plurality of dispersed particles dispersed in the cellular nanomatrix, and a solid-state bond layer extending through the cellular nanomatrix between the dispersed particles.

16. A method of controllably removing the downhole tool of the downhole assembly of claim 1, the method comprising:

disposing the downhole assembly in a downhole environment;

moving the object downhole, with respect to the downhole tool, to engage with the downhole tool and close a switch in the triggering system;

performing a downhole operation using the downhole assembly;

activating the energetic material using the igniter; and degrading the downhole tool.

17. The method of claim 16, wherein closing the switch starts a timer in the triggering system, and activating the energetic material using the igniter occurs at an end of a time period set in the timer.

18. The method of claim 16, wherein the downhole tool is a frac plug, and moving the object downhole includes landing a frac ball on the frac plug.

19. The method of claim 16, wherein the downhole tool includes a sleeve, and moving the object downhole includes landing a ball on the sleeve and shifting the sleeve.

20. A method of controllably removing a downhole tool of a downhole assembly, the method comprising:

starting a timer in a triggering system of the downhole assembly for a pre-selected time period, the downhole tool including degradable-on-demand material having a matrix material and an energetic material configured to generate energy upon activation to facilitate degradation of the downhole tool;

disposing the downhole assembly in a downhole environment;

determining if a downhole operation can be completed within the pre-selected time period, and extending the pre-selected time period to an extended time period if the downhole operation cannot be completed within the pre-selected time period;

performing the downhole operation using the downhole assembly;

activating the energetic material at an end of the pre-selected time period or at an end of the extended time period using the igniter; and degrading the downhole tool.

21. The method of claim 20, further comprising determining if an object usable in the downhole operation has engaged with the triggering system, and extending the pre-selected time period if the object has not engaged with the triggering system.

22. The method of claim 20, wherein the object is a ball and the downhole tool is one of a frac plug and a sliding sleeve.

23. A frac plug comprising:

a body formed of a degradable-on-demand material, the degradable-on-demand material including:

a matrix material; and, a unit in contact with the matrix material, the unit including:

a core comprising an energetic material configured to generate energy upon activation to facilitate the degradation of the downhole tool; and, at least one layer disposed on the core;

a time delay fuse in contact with an uphole end of the body and in contact with the energetic material; and, a ball seat including a piezoelectric material at an uphole end of the time delay fuse;

wherein the piezoelectric material is configured to create a spark and ignite the time delay fuse after a ball is seated on the ball seat and pressure is increased on the ball in a downhole direction.

24. The frac plug of claim 23 wherein the at least one layer includes a protective layer and a support layer, the support layer disposed between the protective layer and the core, the support layer compositionally different than the protective layer.

* * * * *